US009076371B2

(12) United States Patent
Kato et al.

(10) Patent No.: US 9,076,371 B2
(45) Date of Patent: Jul. 7, 2015

(54) DISPLAY DEVICE AND ELECTRONIC APPARATUS USING DISPLAY DEVICE

(75) Inventors: Kazuo Kato, Chiba (JP); Akira Takakura, Chiba (JP); Keisuke Tsubata, Chiba (JP); Hisao Nakamura, Chiba (JP); Tomohiro Ihashi, Chiba (JP); Yoshinori Sugai, Chiba (JP); Eriko Noguchi, Chiba (JP); Satoshi Sakai, Chiba (JP); Takanori Hasegawa, Chiba (JP); Shotaro Kamiyama, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 649 days.

(21) Appl. No.: 13/134,758

(22) Filed: Jun. 16, 2011

(65) Prior Publication Data

US 2011/0310317 A1 Dec. 22, 2011

(30) Foreign Application Priority Data

Jun. 17, 2010 (JP) ..... 2010-138244
Apr. 21, 2011 (JP) ..... 2011-094592

(51) Int. Cl.
*G09G 3/04* (2006.01)
*G09G 3/36* (2006.01)

(52) U.S. Cl.
CPC .. *G09G 3/04* (2013.01); *G09G 3/36* (2013.01); *G09G 2330/021* (2013.01)

(58) Field of Classification Search
CPC ..... G09G 3/04; G09G 3/18; G09G 3/36; G09G 2330/021
See application file for complete search history.

(56) References Cited

U.S. PATENT DOCUMENTS

| | | | | |
|---|---|---|---|---|
| 4,355,381 | A * | 10/1982 | Fujita et al. | 368/187 |
| 4,435,046 | A * | 3/1984 | Nishimura | 349/142 |
| 5,175,936 | A | 1/1993 | Sato | 33/354 |
| 6,181,313 | B1 * | 1/2001 | Yokota et al. | 345/100 |
| 6,429,840 | B1 * | 8/2002 | Sekiguchi | 345/88 |

FOREIGN PATENT DOCUMENTS

| | | |
|---|---|---|
| GB | 2007882 | 5/1979 |
| JP | 2004 178029 | 6/2004 |
| JP | 2004 145210 | 7/2009 |

* cited by examiner

*Primary Examiner* — Dennis Y Kim
(74) *Attorney, Agent, or Firm* — Adams & Wilks

(57) ABSTRACT

A display device includes independently driven common and segment terminals. The common and segment terminals are connected to display components divided into display blocks that are turned ON to perform a display function and are turned OFF so as to not perform the display function. A first driver drives the common terminals using a scanning signal of a predetermined period and a second driver drives the segment terminals using a segment signal synchronized with the scanning signal to correspond to a display signal, so that the display components perform a display corresponding to the display signal. The first driver separates the common terminals into common terminal blocks and drives the common terminals. The first and second drivers perform the driving so that the common and segment terminals which are connected to display blocks that are turned OFF are not supplied with a turn-off signal and are maintained at ground potential.

12 Claims, 17 Drawing Sheets

FIG. 6

ITEMS OF COMMON SIGNAL BY COMMON SIGNAL CHANGEOVER CONTROL CIRCUIT

| | THREE SEPARATIONS | TWO SEPARATIONS | NO SEPARATION |
|---|---|---|---|
| COM0 | C0 | C0 | C0 |
| COM1 | C1 | C1 | C1 |
| COM2 | C2 | C2 | C2 |
| COM3 | C3 | C3 | C3 |
| COM4 | C4 | C4 | C4 |
| COM5 | C0 | C5 | C5 |
| COM6 | C1 | C6 | C6 |
| COM7 | C2 | C7 | C7 |
| COM8 | C3 | C0 | C8 |
| COM9 | C4 | C1 | C9 |
| COM10 | C0 | C2 | C10 |
| COM11 | C1 | C3 | C11 |
| COM12 | C2 | C4 | C12 |
| COM13 | C3 | C5 | C13 |
| COM14 | C4 | C6 | C14 |
| COM15 | C5 | C7 | C15 |

FIG. 7

| MODE | DISPLAY BLOCK 111 | DISPLAY BLOCK 112 | DISPLAY BLOCK 113 |
|---|---|---|---|
| TIME DISPLAY (NORMAL) | DISPLAY OF KINDS OF MARK | DISPLAY OF KINDS OF TIME | NON-DISPLAY (NO DRIVING) |
| AZIMUTH DISPLAY | DISPLAY OF KINDS OF MARK | DISPLAY OF KINDS OF TIME | AZIMUTH DISPLAY |
| POWER SAVE TIME | BLINKING OF MARKS | NON-DISPLAY (NO DRIVING) | NON-DISPLAY (NO DRIVING) |

FIG. 17

| | DISPLAY BLOCK 1601 | DISPLAY BLOCK 1602 | DISPLAY BLOCK 1603 |
|---|---|---|---|
| COMMON DISCONNECTION SWITCH 1601 = DISCONNECTED<br>COM0=ON<br>COM1～7=OFF | ON | OFF | OFF |
| COMMON DISCONNECTION SWITCH 1601 = CONNECTED<br>COMMON DISCONNECTION SWITCH 1602 = DISCONNECTED<br>COM0～7=ON | ON | ON | OFF |
| COMMON DISCONNECTION SWITCH 1601 = CONNECTED<br>COMMON DISCONNECTION SWITCH 1602 = CONNECTED<br>COM0～7=ON | ON | ON | ON |

DISPLAY DEVICE AND ELECTRONIC APPARATUS USING DISPLAY DEVICE

FIELD OF THE INVENTION

The present invention relates to a display device and an electronic apparatus using the display device.

BACKGROUND ART

Hitherto, a display device has been used in various apparatuses such as an electronic timepiece.

In a portable electronic apparatus disclosed in JP-A-2004-178029, the power consumption of a self-luminous type (current driving type) display panel is reduced by reducing the number of dots of a display font when a battery voltage is lowered (normally, 5*10 dots are used, but 5*5 dots are used when the battery voltage is lowered).

In the self-luminous type display panel such as an EL (Electro-luminescence) display panel, the power consumption can be reduced in this way. However, as for a liquid crystal display (LCD) of a reflective display panel, there is a limit in reducing the power consumption since a turn-off signal is output even to cells not being displayed.

For example, in an electronic timepiece having an LCD display section according to the related art, as shown in FIG. 18, there is a limit to reducing the power consumption even when only a charge mark blinks to prompt a user to execute charging in a case where the remaining capacity of a battery becomes low. This is because the turn-off signal is output even to the cells not being displayed.

FIG. 18 is a diagram illustrating an LCD display section of an electronic timepiece having an azimuth display function. A display component is separated into three display blocks A, B, and C. The display block A is a mark display block that displays the remaining battery level. The display block B is a clock time display block that is used when a time or the like is displayed. The display block C is an azimuth display block that displays an azimuth. Common terminals COM0 to COM7 driven at a predetermined period (in other words, a predetermined duty ratio) are connected to the display components of the display blocks A to C. Segment terminals SEG00 to SEG01 are connected to the display components of the display block A, segment terminals SEG02 to SEG51 are connected to the display components of the display block B, and segment terminals SEG52 to SEG63 are connected to the display components of the display block C.

In FIG. 18, the display blocks A and B are driven in a turn-on state and the display block C is driven in a turn-off state. In this case, all of the common terminals COM0 to COM7 are driven at a predetermined period. On the other hand, the segment terminals SEG00 to SEG51 of the display blocks A and B are driven in a turn-on state. In addition, the segment terminals SEG52 to SEG63 of the display block C are driven in the turn-off state by a turn-off signal. Thus, the display components of the display blocks A and B are turned on and the display components of the display block C are turned off. However, since the segment terminals SEG52 to SEG63 of the display block C are driven by the turn-off signal, it is difficult to reduce the power consumption.

In a multilayer liquid crystal timepiece disclosed in JP-A-54-45169, independent LCDs are provided, displays for the normally displayed hours, minutes, and seconds are disposed externally, and a calendar display called as necessary is disposed internally, so that visibility of a typical timepiece can be realized normally by the displays for hours, minutes, and seconds.

However, since the turn-off signal is output even to the cells not being displayed, there is a limit to reducing the power consumption.

Likewise, an LCD driving signal may not be separated in an electronic azimuth-finder-mounted wristwatch, in which a time display LCD and an azimuth display LCD overlap with each other, or an electronic azimuth-finder-mounted wristwatch, in which azimuth display cells are disposed around a display region (see JP-A-3-262918). Therefore, since the turn-off signal is output to the azimuth display LCD panel even while an azimuth display is not performed, there is a limit to reducing the power consumption.

In a radio wave reception device disclosed in JP-A-2009-145210, a liquid crystal display panel is separated into two regions, an antenna is disposed below a first display region, and display driving of the first display region is stopped during reception of standard radio waves, so that the antenna blocks the influence of noise from the LCD. By controlling a first display driving circuit section 207 and a second display driving circuit section 208, it is possible to independently control the first and second display regions.

The power consumption can be reduced by stopping the display driving of the first display region. However, since the number of cells in the first display area and the number of cells of the second display area are fixed, a problem may arise in that it is necessary to develop a dedicated LSI (Large Scale Integration Circuit) for each kind of device even when display forms are different.

SUMMARY OF THE INVENTION

It is an aspect of the present application to provide a display device and an electronic apparatus including the display device capable of reducing power consumption and achieving a plurality of different display forms.

According to another aspect of the present application, there is provided a display device including: a plurality of common terminals and a plurality of segment terminals connected to a plurality of display components; first driving means for driving the common terminals; and second driving means for driving the segment terminals based on a display signal. The first driving means drives the plurality of common terminals using a scanning signal of a predetermined period and the second driving means drives the plurality of segment terminals using a segment signal synchronized with the scanning signal to correspond to the display signal, so that the display components perform a display corresponding to the display signal. The common terminals and the segment terminals are able to be independently driven. The first driving means separates the plurality of common terminals into a plurality of common terminal blocks and drives the plurality of common terminals and the number of separated common terminal blocks is variable.

According to another aspect of the present application, there is provided an electronic apparatus including display means. The display means is configured by the display device according to the above aspect of the invention.

According to the display device of the aspect of the present application, it is possible to reduce the power consumption and achieve a plurality of different display forms.

According to the electronic apparatus of the aspect of the present application, it is possible to reduce the power consumption and achieve the plurality of different display forms.

BRIEF DESCRIPTION OF THE DRAWINGS

FIG. 6 is a table used to make description according to the first embodiment of the invention.

FIG. 7 is a table used to make description according to the first embodiment of the invention.

FIG. 17 is a table according to the fourth embodiment of the invention.

DETAILED DESCRIPTION OF THE INVENTION

First Embodiment

Figure 1:
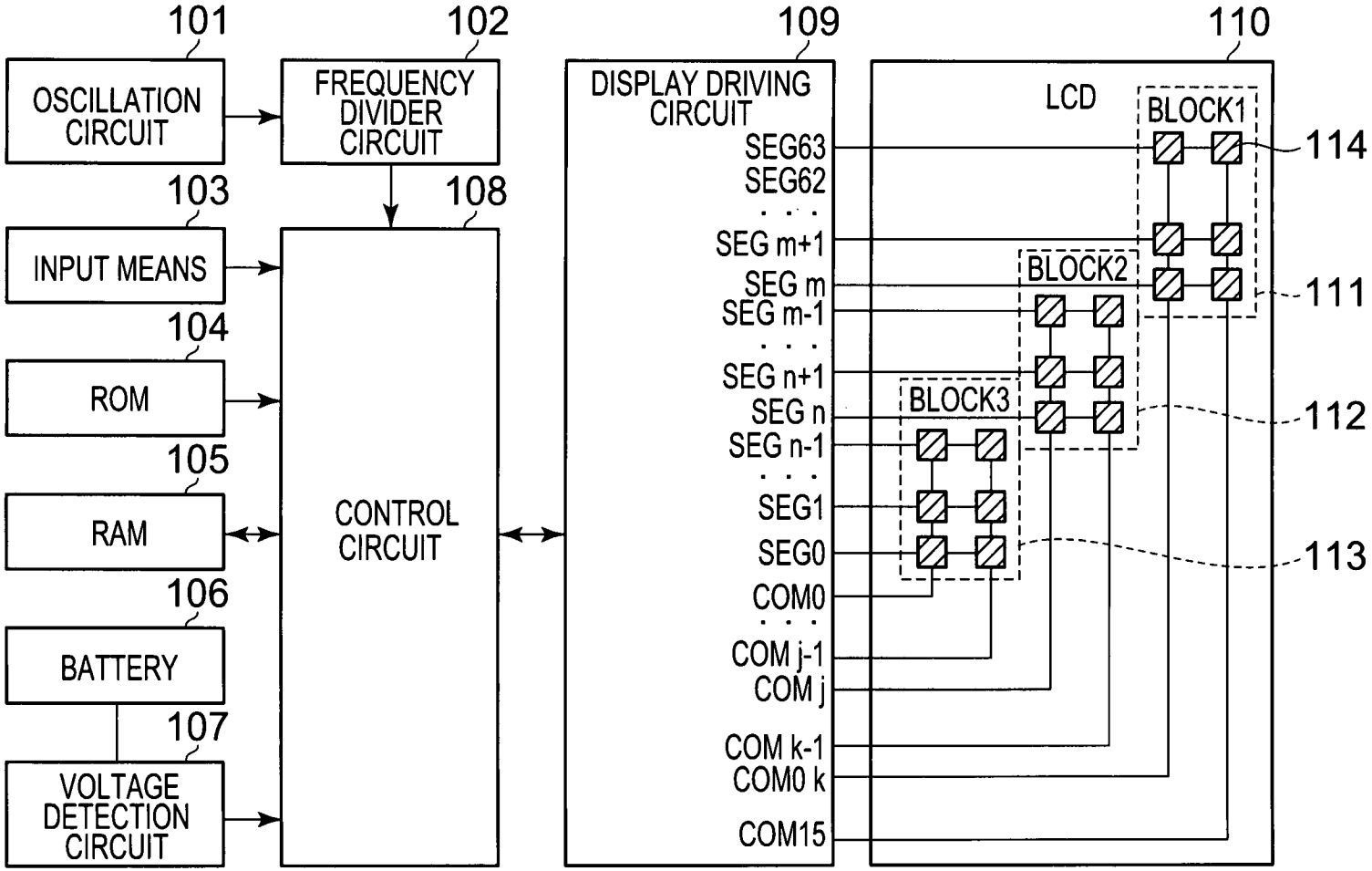
FIG. 1 is a block diagram illustrating an electronic apparatus according to a first embodiment of the invention.

Hereinafter, a display device and an electronic apparatus using the display device will be described with reference to the drawings according to a first embodiment of the invention. The same reference numerals are given to the same constituent elements through the drawings.

FIG. 1 is a block diagram illustrating an electronic timepiece as an example of an electronic apparatus according to the first embodiment of the invention.

In FIG. 1, the electronic timepiece includes an oscillation circuit 101 generating a signal with a predetermined frequency; a frequency divider circuit 102 dividing the signal generated by the oscillation circuit 101 and generating a time measurement signal serving as a reference for time measurement; and a control circuit 108 performing time measurement based on the time measurement signal or control of each electronic circuit component of the electronic timepiece. The control circuit 108 includes a central processing unit (CPU).

The electronic timepiece further includes input means 103 for performing a mode changing operation or the like executed by a user; a read-only memory (ROM) 104 storing a program executed by the CPU of the control circuit 108 in advance; a random access memory (RAM) 105 storing data regarding a measured time or the like; a battery 106 serving as a power source of the electronic timepiece; and a voltage detection circuit 107 detecting the voltage of the battery 106.

The electronic timepiece further includes a display driving circuit 109 and a display section 110 including a liquid crystal display device (LCD). The display section 110 includes a plurality of display components 114 serving as pixels that display various kinds of information such as a time. The plurality of display components 114 is divided into a plurality of display blocks 111, 112, and 113 (three display blocks in FIG. 1).

The display components are connected in a matrix shape to segment terminals SEG and common terminals COM. The common terminals COM and the segment terminals SEG are configured to be independently driven.

Under the control of the control circuit 108, the display driving circuit 109 scans and drives the common terminals COM for each of the display blocks 111 to 113 in a predetermined sequence at a predetermined period (in other words, predetermined duty ratio); and drives the segment terminals SEG based on a display signal supplied from the control circuit 108 in synchronization with the scanning drive of the respective common terminals COM. Thus, the display driving circuit 109 drives the display section 110 based on the display signal from the control circuit 108 so that the display components 114 of the display section 110 realize a display corresponding to the display signal in each block unit.

Figure 2:
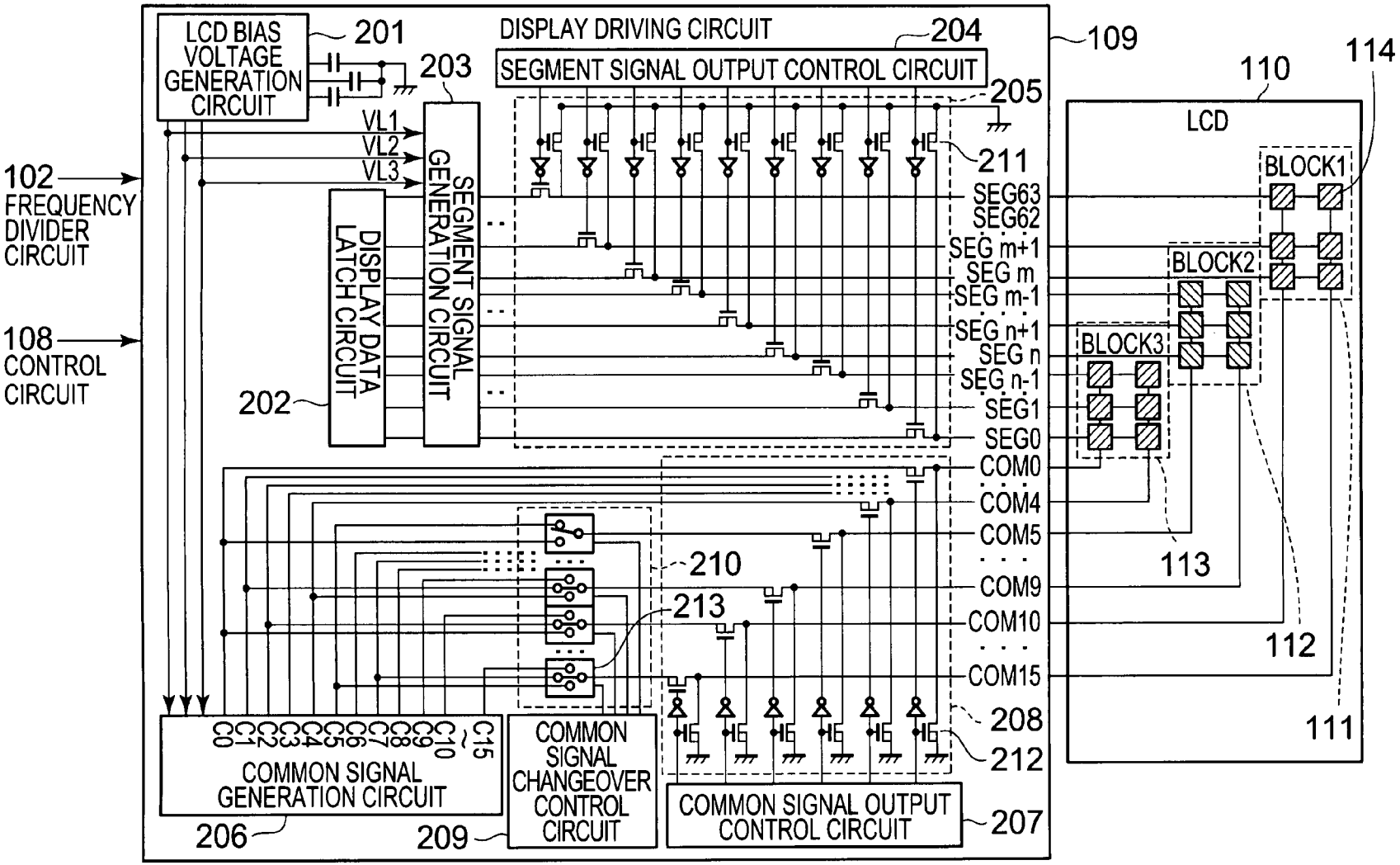
FIG. 2 is a block diagram illustrating the partial details of the electronic apparatus according to the first embodiment of the invention.

FIG. 2 is a block diagram illustrating the details of the configuration of the display driving circuit 109.

In FIG. 2, the display driving circuit 109 includes an LCD bias voltage generation circuit 201 that generates a predetermined bias voltage supplied to the common terminals COM and the segment terminals SEG; a display data latch circuit 202 that latches display data corresponding to the display signal from the control circuit 108; a segment signal generation circuit 203 that generates a segment signal, which corresponds to the display data, for driving the segment terminals SEG; a segment signal output control circuit 204 that controls supply of a driving signal for the segment terminals SEG, and a segment switch circuit 205 that includes a plurality of segment driving switches 211 controlled to be opened and closed by the segment signal output control circuit 204 and supplies the segment signal corresponding to the display data to the respective segment terminals SEG. The segment signal is supplied to each of the segment terminals SEG at a timing synchronized with a scanning timing of the common terminals COM.

The display driving circuit 109 further includes a common signal generation circuit 206 that generates a common signal for scanning and driving the common terminals COM at a predetermined period (in other words, predetermined duty ratio) in a predetermined sequence; a common signal output control circuit 207 that controls supply of the driving signal to the common terminals COM; and a common switch circuit 208 that includes a plurality of common driving switches 212 that is controlled to be opened and closed by the common signal output control circuit 207 and supplies the common signal to the common terminals COM at a predetermined period.

The display driving circuit 109 further includes a common signal changeover control circuit 209 changing over a separation number (common terminal separation number) of the common terminals COM; and a common changeover circuit 210 that is disposed between the common signal generation circuit 206 and the common switch circuit 208. The common changeover circuit 210 includes a plurality of common changeover switches 213 changed over by the common signal changeover control circuit 209 to change over the common terminal separation number.

As described in detail below, the feature of this embodiment is a configuration in which the common signal changeover control circuit 209 and the common changeover circuit 210 vary the common terminal separation number and the other configuration is known.

First driving means is configured by the control circuit 108, the LCD bias voltage generation circuit 201, the common signal generation circuit 206, the common signal output control circuit 207, the common switch circuit 208, the common signal changeover control circuit 209, and the common changeover circuit 210. Changeover means is configured by the control circuit 108, the common signal changeover control circuit 209, and the common changeover circuit 210. Second driving means is configured by the LCD bias voltage generation circuit 201, the display data latch circuit 202, the segment signal generation circuit 203, the segment signal output control circuit 204, and the segment switch circuit 205.

Figure 3:
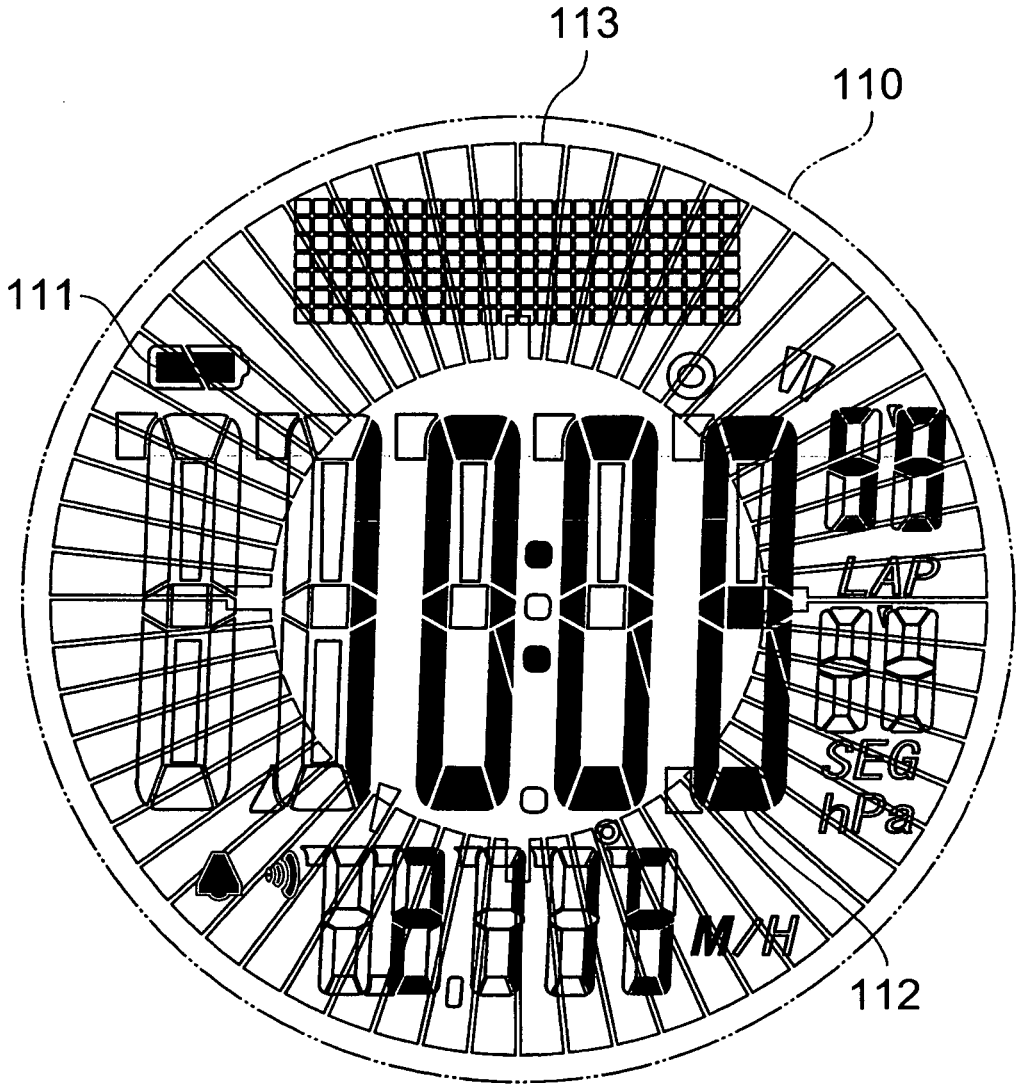
FIG. 3 is a diagram illustrating a display form according to the first embodiment of the invention.
Figure 4:
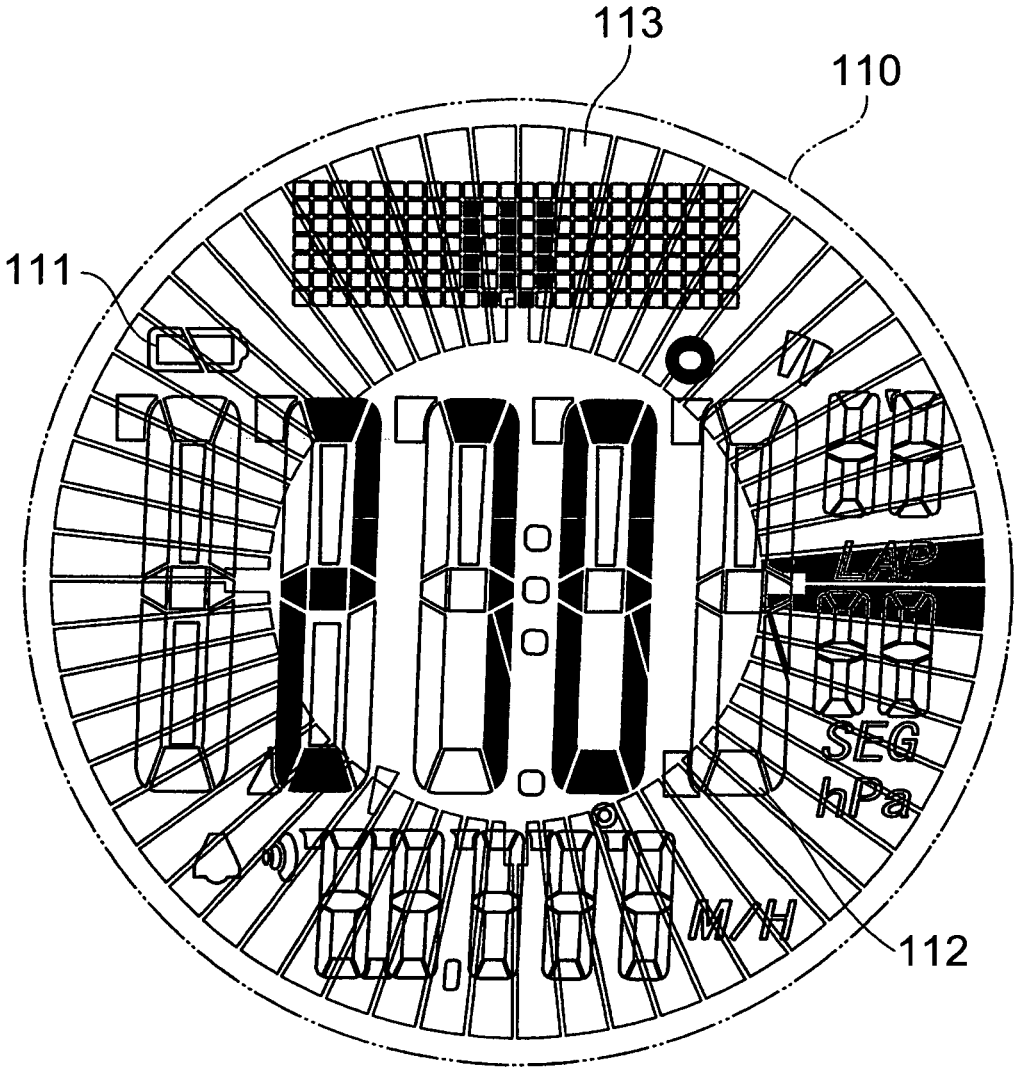
FIG. 4 is a diagram illustrating a display form according to the first embodiment of the invention.
Figure 5:
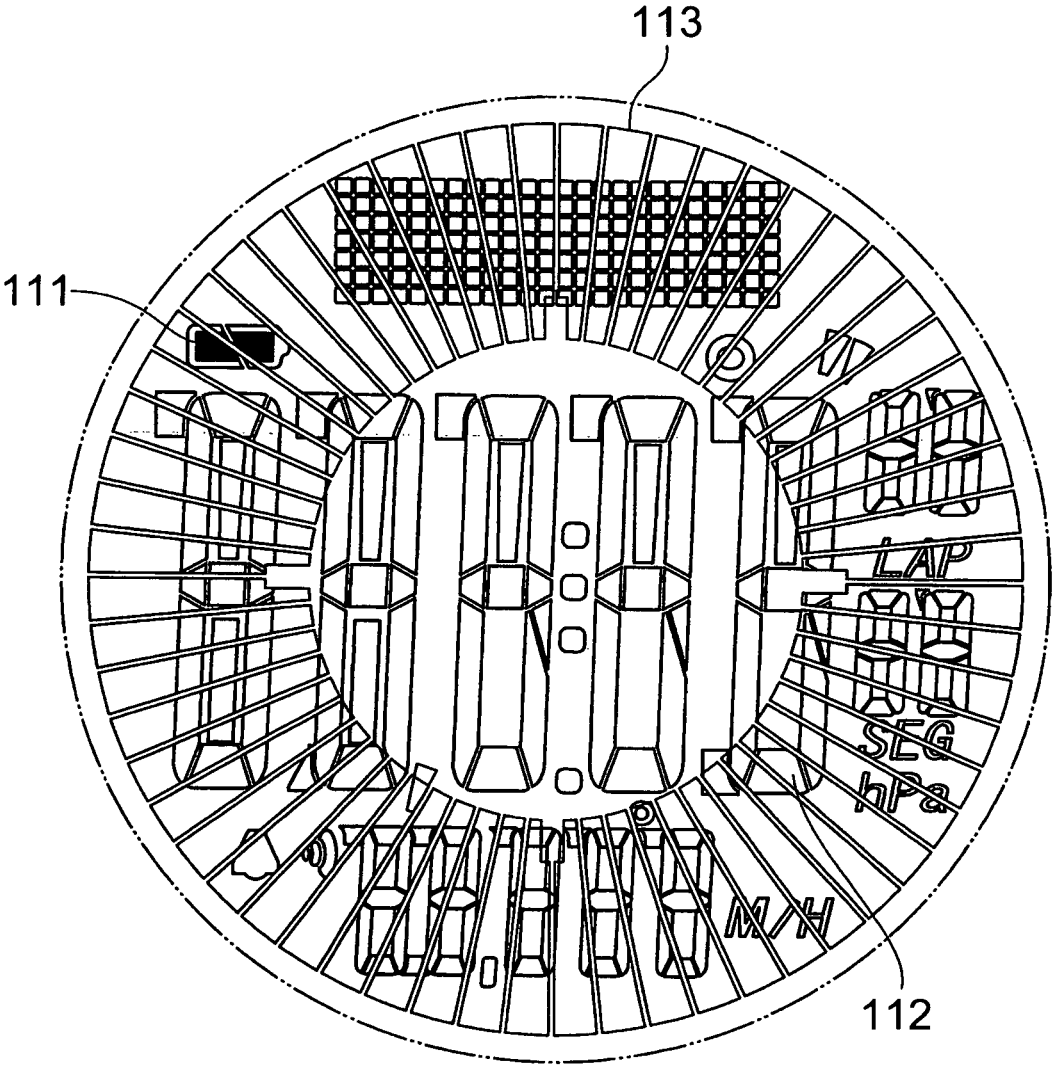
FIG. 5 is a diagram illustrating a display form according to the first embodiment of the invention.

FIGS. 3 to 5 are diagrams illustrating display forms of the display section 110.

In FIGS. 3 to 5, the display section 110 has a configuration in which a time display LCD disposed inside overlaps with an azimuth display LCD disposed on the front surface side. A display block 111 displays a battery mark indicating a remaining battery level. A display block 112 displays kinds of time. A display block 113 displays an azimuth.

In FIG. 3, when the voltage detection circuit 107 detects the voltage of the battery 106 and the voltage is equal to or higher than a predetermined value, a sufficient remaining level of the battery 106 is displayed by turning on the battery mark of the display block 111. Moreover, a time is displayed by turning on the display block 112. The display block 113 is not driven (non-driven state).

In FIG. 4, an azimuth (where three o'clock direction indicates the north and twelve o'clock direction indicates the west (W)) is displayed by turning on the display block 112. In addition, a time or a battery mark is displayed by turning on the display blocks 111 and 113.

In FIG. 5, a power save display state is shown. In this state, only the battery mark of the display block 111 is displayed in a blinking manner at a predetermined frequency (for example, 2 Hz) and the display blocks 112 and 113 are in a non-driven state.

The display driving forms shown in FIGS. 3 to 5 are summarized in the table shown in FIG. 7.

When the plurality of common terminals COM is separated into a plurality of blocks (common terminal blocks) and is driven, changeover control shown in FIG. 6 is performed by the common signal changeover control circuit 209.

FIG. 6 is a table illustrating a connection state of the common signal by the common signal changeover control circuit 209. In this table, there are three separation patterns of a case where the plurality of common terminals COM is separated into three common terminal blocks and is driven, a case where the plurality of common terminals COM is separated into two common terminal blocks and is driven, and a case where the plurality of common terminals COM is not separated.

When the common terminals COM0 to COM15 are separated into three common terminal blocks, the common terminals COM0 to COM15 are separated into three display blocks (common terminals COM0 to COM4, common terminals COM5 to COM9, and common terminals COM10 to COM15) and the common signal changeover control circuit 209 controls changeover of the respective common changeover switches 213 of the common changeover circuit 210 so that output terminals C0 to C15 of the common signal generation circuit 206 are allocated to the common terminals ((the common terminals COM0, COM5, and COM10), (the common terminals COM1, COM6, and COM11), . . . , (the common terminals COM4, COM9, and COM14), and (the common terminal COM15)) corresponding to the common terminal blocks, respectively.

When the common terminals COM are separated into two common terminal blocks, the common terminals COM0 to COM15 are separated to two common terminal blocks (the common terminals COM0 to COM7 and the common terminals COM8 to COM15) and the common signal changeover control circuit 209 controls changeover of the respective common changeover switches 213 of the common changeover circuit 210 so that the output terminals C0 to C7 of the common signal generation circuit 206 are allocated to the common terminals ((the common terminals COM0 and COM8), (the common terminals COM1 and COM9), . . . , (the common terminals COM7 and COM15)) corresponding to the common terminal blocks, respectively.

When the common terminals COM are not separated into the plurality of common terminal blocks, the common signal changeover control circuit 209 controls changeover of the common changeover switches 213 of the common changeover circuit 210 so that the output terminals C0 to C15 of the common signal generation circuit 206 are allocated to the common terminals COM0 to COM15, respectively.

Figure 8A:
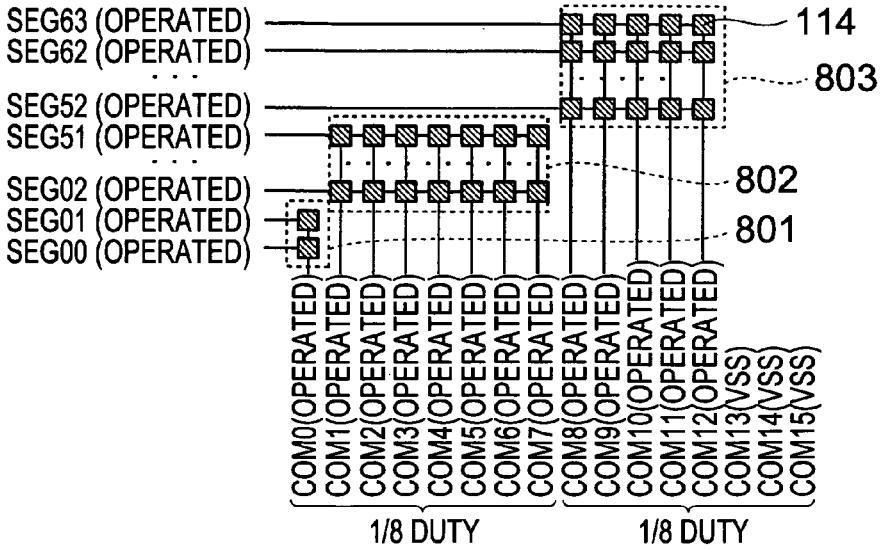
FIGS. 8A to 8C are diagrams illustrating an operation according to the first embodiment of the invention.
Figure 8B:
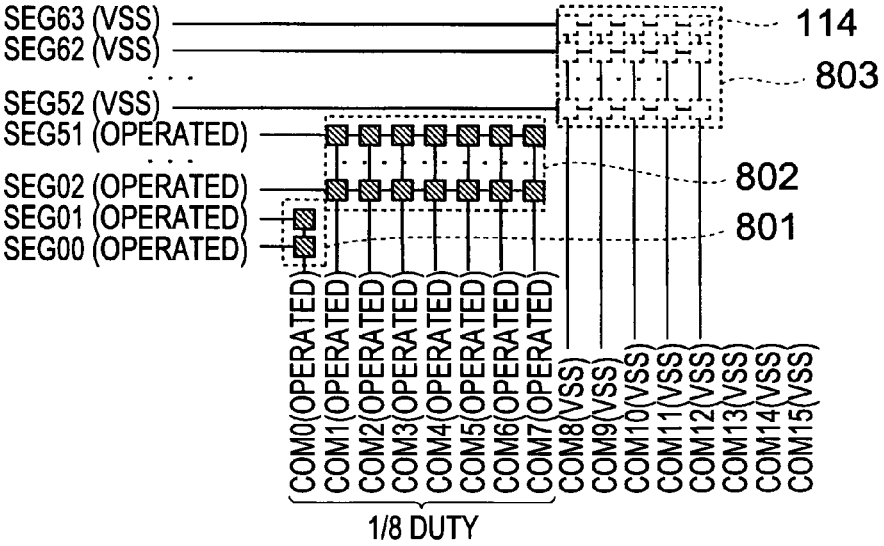
Figure 8C:
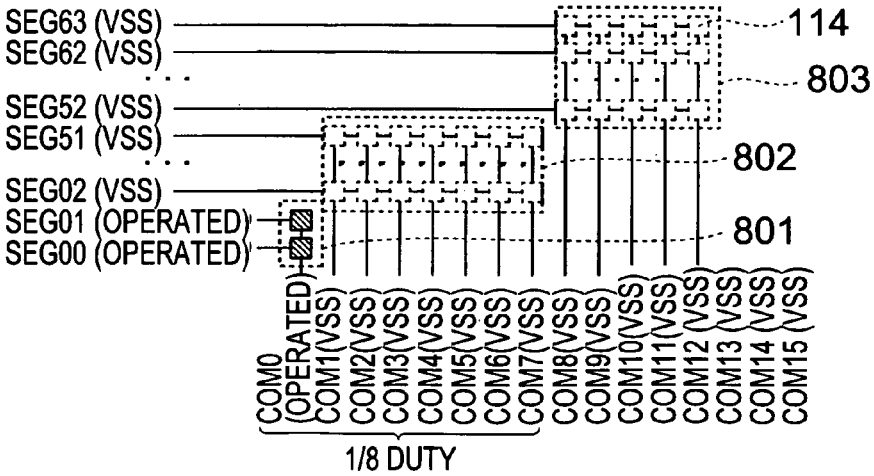

FIGS. 8A to 8C are diagrams illustrating a relationship among the segment terminals SEG, the common terminals COM, and the display blocks. The plurality of display components 114 is separated into a plurality of display blocks 801, 802, and 803 (three display blocks in FIGS. 8A to 8C) by separating plurality of segment terminals SEG00 to SEG63 into a plurality of blocks (segment terminal blocks). In response to a separation instruction from the control circuit 108, the common signal changeover control circuit 209 separates the common terminals COM0 to COM15 into the plurality of common terminal blocks (two common terminal blocks in FIGS. 8A to 8C) by controlling changeover of the respective common changeover switches 213 of the common changeover circuit 210.

The segment terminals SEG00 and SEG01 and the common terminal COM0 are connected to the display components 114 of the mark display block 111. The segment terminals SEG02 to SEG51 and the common terminals COM1 to COM7 are connected to the display components 114 of the time display block 112. The segment terminals SEG52 to SEG63 and the common terminals COM8 to COM12 are connected to the display components 114 of the azimuth display block 803. The common terminals COM13 to COM15 are not connected to the display components 114 and are in an open state.

The common signal output control circuit 207 supplies the common signal, which has been supplied from the common signal generation circuit 206 via the common changeover circuit 210 to common terminals COM0 to COM15 via the common switch circuit 208. At this time, the common terminals COM0 to COM15 are separated into two common terminal blocks of the common terminals COM0 to COM7 and the common terminals COMB to COM15 and are driven (see "two separations" in FIG. 6). Thus, the display blocks 113 and 112 connected to the common terminals COM0 to COM7 are driven at 1/8 duty ratio. The display block 111 connected to the common terminals COM8 to COM12 is also driven at 1/8 duty ratio. Accordingly, each common terminal block is driven with the same duty ratio.

Accordingly, by configuring the number of common terminals COM included in the common terminal blocks so as to be changed depending on display forms and varying the duty ratio at which the display pixels 114 are driven, it is possible to change the luminance or the like of the display block corresponding to each common terminal block variously. Moreover, since a circuit with a low frequency can be used by enlarging the duty ratio, in other words, by lowering a scanning frequency, the power consumption can be further reduced.

In addition, the setting of the separation number of common terminals COM may be performed at the manufacturing time. In this case, the separation number is set by the control circuit 108. The control circuit 108 controls the common signal changeover control circuit 209 in accordance with the separation number. Moreover, a user may set the luminance or the separation number through the input means 103. In this case, the control circuit 108 controls the common signal changeover control circuit 209 in accordance with the luminance or the separation number designated through the input means 103.

In a case of an azimuth display mode in FIG. 7, as shown in FIG. 8A, all of the display blocks 801 to 803 are driven for display to realize the displays of the respective display blocks 801 to 803. The display driving state of the display components 114 of the respective display blocks 801 to 803 is indicated by hatching.

In this case, the common terminals COM0 to COM7 and the common terminals COM8 to COM12 are driven in an operation state (turn-on state) of a 1/8 duty ratio. The segment terminals SEG00 to SEG63 are driven in the operation state (turn-on state) in accordance with the display signal, while the segment terminals SEG00 to SEG51 are driven in synchronization with the common terminals COM0 to COM7 and the segment terminals SEG52 to SEG63 are driven in synchronization with the common terminal COM8 to COM12.

On the other hand, all of the common terminals COM13 to COM15 which are not connected to the display components 114 are driven at the 1/8 duty ratio at the ground potential (Vss) (OFF state). Thus, the respective display blocks 801 to 803 are driven for display at the 1/8 duty ratio.

In a case of a time display mode in FIG. 7, as shown in FIG. 8B, the display blocks 802 and 801 are driven for display at the 1/8 duty ratio to display the kinds of time and the battery mark.

In this case, the common terminals COM0 to COM7 are driven in an operation state (turn-on state) at the 1/8 duty ratio. The segment terminals SEG00 to SEG51 are driven in the operation state (turn-on state) in synchronization with the common terminals COM0 to COM7 in accordance with the display signal.

On the other hand, the segment terminals SEG52 to SEG63 and the common terminals COM8 to COM12 connected to the display components 114 of the display block 113 are driven at the ground potential (Vss) (OFF state). Thus, the display blocks 802 and 801 (kinds of time and the battery mark) are displayed, but the display block 113 (azimuth) is turned off. The non-display driving state of the display components 114 of the display block 113 is indicated by a broken-line white.

The segment terminals SEG and the common terminals COM connected to the display block which is not displayed (turned off) are supplied with no turn-off signal and are at the ground potential Vss (OFF state). According to the related art, since the turn-off signal is supplied to the display block not being displayed, a given power is consumed even in the turn-off state. However, according to this embodiment, since the segment terminals SEG and the common terminals COM connected to the display block which is not displayed (turned off) are not supplied with a turn-off signal, no power is consumed in the display block not being displayed, and power saving can be achieved.

In a case of a power save mode in FIG. 7, as shown in FIG. 8C, only the display block 801 is driven for display at the 1/8 duty ratio to display only the display block 801 (the battery mark) in a blinking manner.

In this case, the common terminal COM0 is driven in the operation state (turn-on state) at the 1/8 duty ratio and the segment terminals SEG00 and SEG01 are driven in the operation state (turn-on state) in synchronization with the common terminal COM0 in accordance with the display signal.

On the other hand, the segment terminals SEG02 to SEG63 and the common terminals COM1 to COM12 connected to the display components 114 of the display blocks 802 and 803 are driven at the ground potential (Vss) (OFF state).

Thus, the segment terminals SEG and the common terminals COM connected to the display block not being displayed (turned off), as in FIG. 8B, are not supplied with a turn-off signal and are driven at the ground potential Vss (OFF state). Accordingly, no power is consumed in the display block not being displayed and thus the power saving can be achieved according to this embodiment.

Figure 9A:
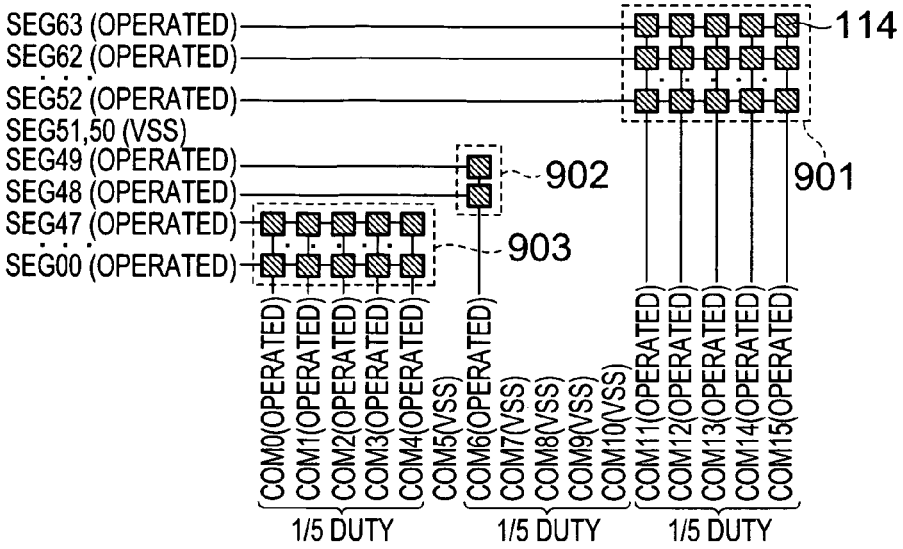
FIGS. 9A to 9C are diagrams illustrating an operation according to the first embodiment of the invention.
Figure 9B:
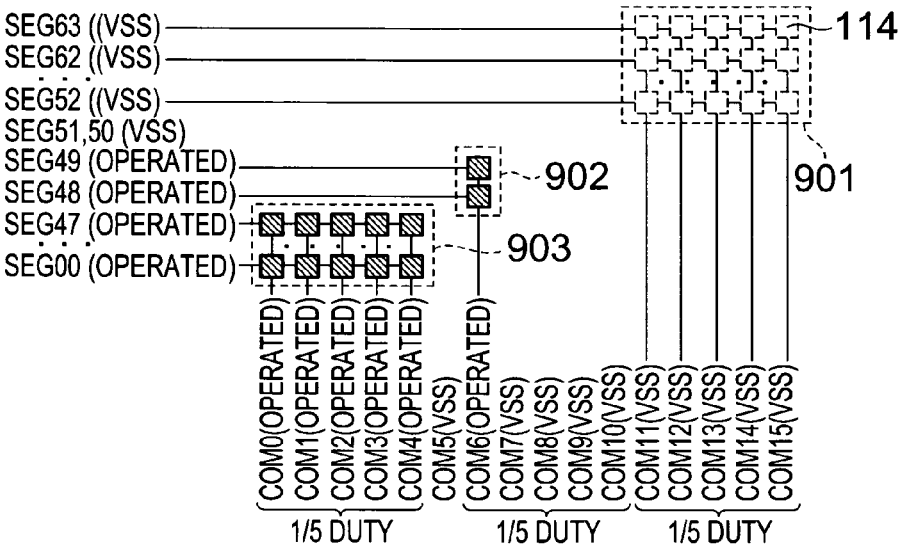
Figure 9C:
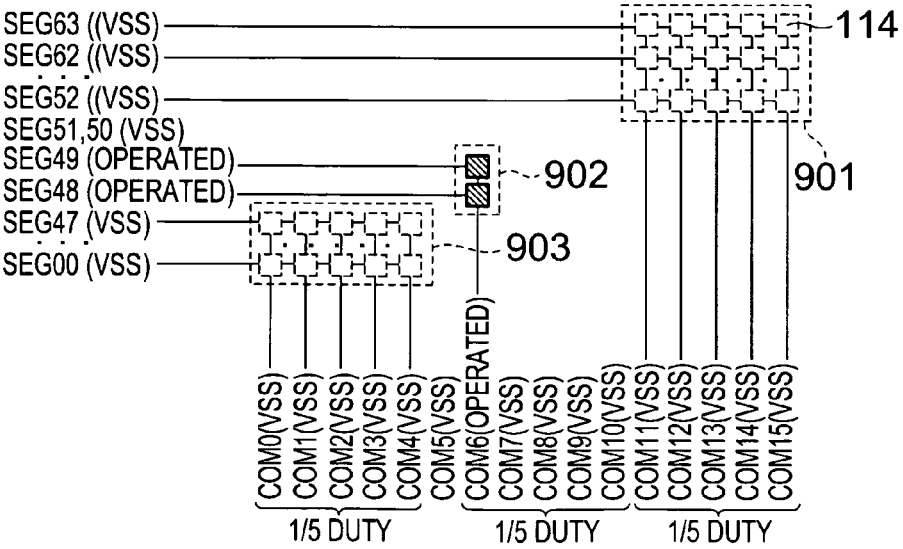

FIGS. 9A to 9C are diagrams illustrating an example of the separation of the common terminals COM different from that of FIGS. 8A to 8C.

In FIGS. 9A to 9C, the plurality of segment terminal blocks (three segment terminal blocks in FIGS. 9A to 9C) are separated to form a plurality of display blocks 901 to 903 (three display blocks in FIGS. 9A to 9C). In addition, in response to a separation instruction from the control circuit 108, the common signal changeover control circuit 209 changes over the respective common changeover switches 213 of the common changeover circuit 210 to separate the common terminals COM0 to COM15 into a plurality of common terminal blocks (three common terminal blocks in FIGS. 9A to 9C).

The segment terminals SEG00 to SEG47 and the common terminals COM0 to COM4 are connected to the display components 114 of the time display block 903. The segment terminals SEG48 and SEG49 and the common terminal COM6 are connected to the display components 114 of the mark display block 902. The segment terminals SEG52 to SEG63 and the common terminals COM11 to COM15 are connected to the display components 114 of the azimuth display block 901. The segment terminals SEG50 and SEG51 and the common terminals COM5 and COM7 to COM10 are not connected to the display components 114 and are in an open state.

The common signal output control circuit 207 supplies the common signal, which has been supplied from the common signal generation circuit 206 via the common changeover circuit 210, to the common terminals COM0 to COM15 via the common switch circuit 208. At this time, the common terminals COM0 to COM15 are separated into three common terminal blocks of the common terminals COM0 to COM4, the common terminals COM5 to COM9, and the common terminals COM10 to COM15 and are driven (see "three separations" in FIG. 6). Thus, the common terminals COM0 to COM4, the common terminal COM6, and the common terminals COM11 to COM15 are each driven at a 1/5 duty ratio and the display blocks 901 to 903 are driven for display at the 1/5 duty ratio.

Accordingly, by configuring the number of common terminals COM included in the common terminal blocks so as to be changed depending on display forms and varying the duty ratio at which the display pixels 114 are driven, it is possible to change the luminance or the like of the display block corresponding to each common terminal block variously.

In the case of an azimuth display mode in FIG. 9A, all of the display blocks 901 to 903 are driven for display to realize the displays.

In this case, the common terminals COM0 to COM4, the common terminal COM6, and the common terminals COM11 to COM15 are driven in an operation state of the 1/5 duty ratio. The segment terminals SEG00 to SEG63 are driven in the operation state in accordance with the display signal, while the segment terminals SEG00 to SEG47 are driven in synchronization with the common terminals COM0 to COM4 and the segment terminals SEG48 and SEG49 are driven in synchronization with the common terminal COM6, and the segment terminals SEG52 to SEG63 are driven in synchronization with the common terminal COM11 to COM15.

On the other hand, all of the common terminals COM5 and COM7 to COM10 which are not connected to the display components 114 are driven at the 1/5 duty ratio at the ground potential (Vss) (OFF state). Thus, the respective display blocks 901 to 903 are driven for display at the 1/5 duty ratio. All of the segment terminals SEG which are not connected to the display components 114 are also driven at the ground potential (Vss).

In a case of the time display mode in FIG. 9B, the display blocks 902 and 903 are driven for display at the 1/5 duty ratio to realize the displays of the display blocks 902 and 903.

In this case, the common terminals COM0 to COM4 and the common terminal COM6 are driven at the 1/5 duty ratio in the operation state. In synchronization with this driving of the common terminals, the segment terminals SEG00 to SEG49 are driven in the operation state in accordance with the display signal.

On the other hand, all of the common terminals COM5 and COM7 to COM10 which are not connected to the display components 114 are driven at the 1/5 duty ratio at the ground potential (Vss) (OFF state). The segment terminals SEG are also driven at the ground potential (Vss). The segment terminals SEG50 to SEG63 are driven at the ground potential (Vss).

Thus, the display blocks 902 and 903 are driven for display at the 1/5 duty ratio, while the display block 901 is turned off.

In a case of the power save mode in FIG. 9C, only the display block 902 is driven for display at the 1/5 duty ratio to display only the display block 902 in a blinking manner.

Thus, the segment terminals SEG and the common terminals COM connected to the display block not being displayed (turned off), as in FIG. 8B, are supplied with no turn-off signal and are driven at the ground potential Vss (OFF state). Accordingly, no power is consumed in the display block not being displayed and thus the power saving can be achieved according to this embodiment.

Figure 10A:
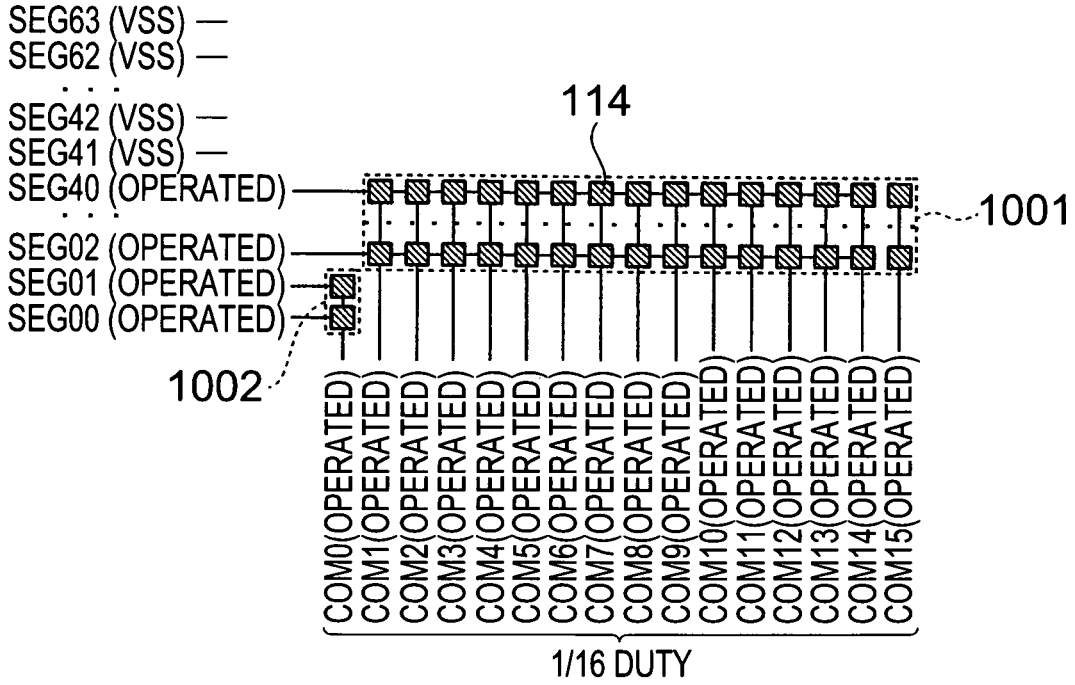
FIGS. 10A and 10B are diagrams illustrating an operation according to the first embodiment of the invention.
Figure 10B:
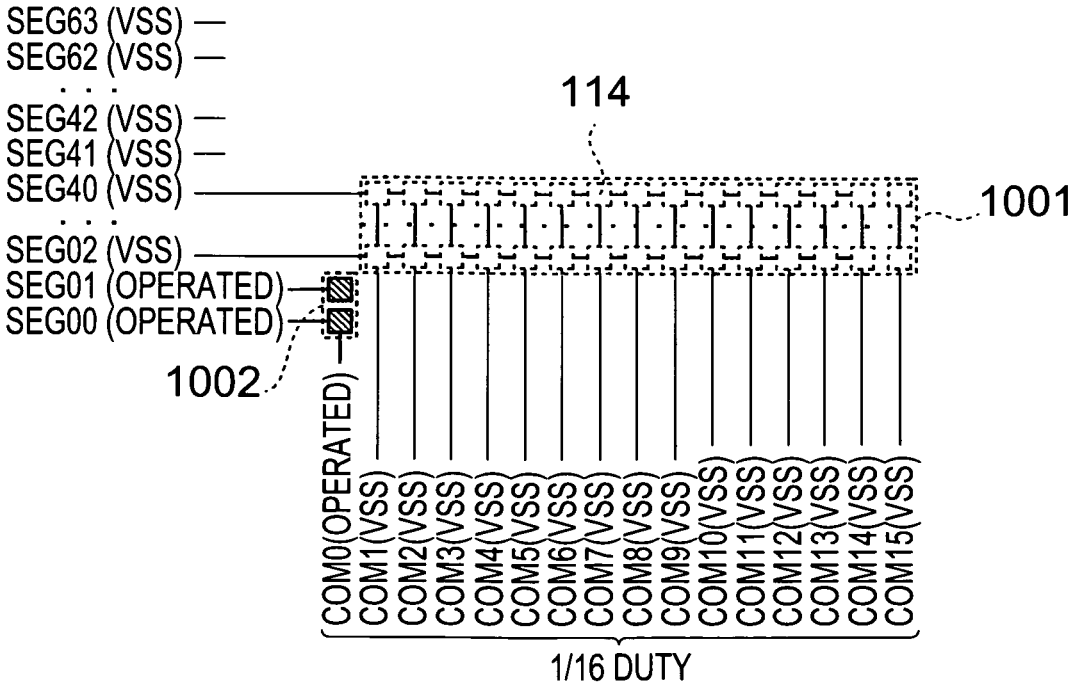

FIGS. 10A and 10B are diagrams illustrating another example of the separation of the common terminals COM.

In FIGS. 10A and 10B, the plurality of segment terminal blocks (two segment terminal blocks in FIGS. 10A and 10B) are separated to form a plurality of display blocks 1001 and 1002 (two display blocks in FIGS. 10A and 10B), but the common terminals COM0 to COM15 are not separated.

The segment terminals SEG00 and SEG01 and the common terminal COM0 are connected to the display component 114 of the mark display block 1002. The segment terminals SEG02 to SEG40 and the common terminals COM1 to COM15 are connected to the display components 114 of the time display block 1001. The segment terminals SEG41 to SEG63 are not connected to the display components 114 and are in an open state.

The common signal output control circuit 207 supplies the common signal, which has been supplied from the common signal generation circuit 206 via the common changeover circuit 210, to the common terminals COM0 to COM15 via the common switch circuit 208. At this time, the common terminals COM0 to COM15 are not separated into the plurality of common terminal blocks and are driven (see "no separation" in FIG. 6). Thus, the common terminals COM0 to COM15 are each driven at a 1/16 duty ratio and the display components 114 of the display blocks 1001 and 1002 are driven for display at the 1/16 duty ratio.

Accordingly, by configuring the number of common terminals COM included in the common terminal blocks so as to be changed depending on display forms and varying the duty ratio at which the display pixels 114 are driven, it is possible to change the luminance or the like of the display block corresponding to each common terminal block variously.

In a case of the time display mode in FIG. 10A, all of the display blocks 1001 and 1002 are driven for display to realize the displays. In this case, the segment terminals SEG00 to SEG40 are driven in the operation state in accordance with the display signal and the common terminals COM0 to COM15 are driven in the operation state at the 1/16 duty ratio. On the other hand, all of the segment terminals SEG41 to SEG63 which are not connected to the display components 114 are driven at the ground potential (Vss) (OFF state).

Thus, the display components 114 of the respective display blocks 1001 and 1002 are driven for display at the 1/16 duty ratio.

In a case of the power save mode in FIG. 10B, only the display block 1002 is driven for display at the 1/16 duty ratio. The segment terminals SEG02 to SEG40 and the common terminals COM1 to COM15 connected to the display components 114 of the display block 1001 are driven at the ground potential Vss (OFF state). Moreover, the segment terminals SEG41 to SEG63 which are not connected to the display components 114 are also driven at the ground potential Vss (OFF state). Thus, only the battery mark of the display block 1002 is displayed in a blinking manner.

Thus, in the example of FIGS. 10A and 10B, the segment terminals SEG and the common terminals COM connected to the display block not being displayed (turned off), as in FIG. 9B, are supplied with no turn-off signal and are driven at the ground potential Vss (OFF state). Accordingly, no power is consumed in the display block not being displayed and thus the power saving can be achieved according to this embodiment.

As described above, the display device according to this embodiment includes the plurality of common terminals COM and the plurality of segment terminals SEG connected to the plurality of display components 114; the first driving means for driving the common terminals COM; and the second driving means for driving the segment terminals SEG based on a display signal. The first driving means drives the plurality of common terminals COM using the scanning signal of a predetermined period and the second driving means drives the plurality of segment terminals SEG using a segment signal synchronized with the scanning signal to correspond to the display signal, so that the display components 114 perform a display corresponding to the display signal. The common terminals COM and the segment terminals SEG are able to be independently driven. The first driving means separates the plurality of common terminals COM into a plurality of common terminal blocks and drives the plurality of common terminals COM and the number of separated common terminal blocks is variable.

In the display device, the first driving means includes changeover means for performing changeover so as to separate the plurality of common terminals COM into the predetermined number of common terminal blocks and drive the plurality of common terminals.

Moreover, the first driving means and second driving means perform the driving so that the display components 114 are in a turn-on state or an OFF state.

Here, the electronic apparatus is an electronic timepiece including time measurement means for measuring a time. The display means displays the time when the time measurement means measures the time.

According to the display device of this embodiment, it is possible to reduce power consumption and achieve a plurality of different display forms.

Moreover, the display components 114 are driven to be in the turn-on state or the OFF state. Therefore, since no turn-off signal is supplied to the display components 114 not being displayed, it is possible to reduce unnecessary power consumption.

Since one of plurality of configurations of the common terminals COM of the liquid crystal display device can be selected, it is possible to correspond to apparatuses realizing different display forms with one LSI.

By changing the separation number and changing the duty ratio, it is possible to change the power consumption depending on specifications. For example, by increasing the separation number of common terminals COM depending on product specifications, the driving frequency can be lowered, thereby achieving the lower power consumption.

Second Embodiment

Figure 11:
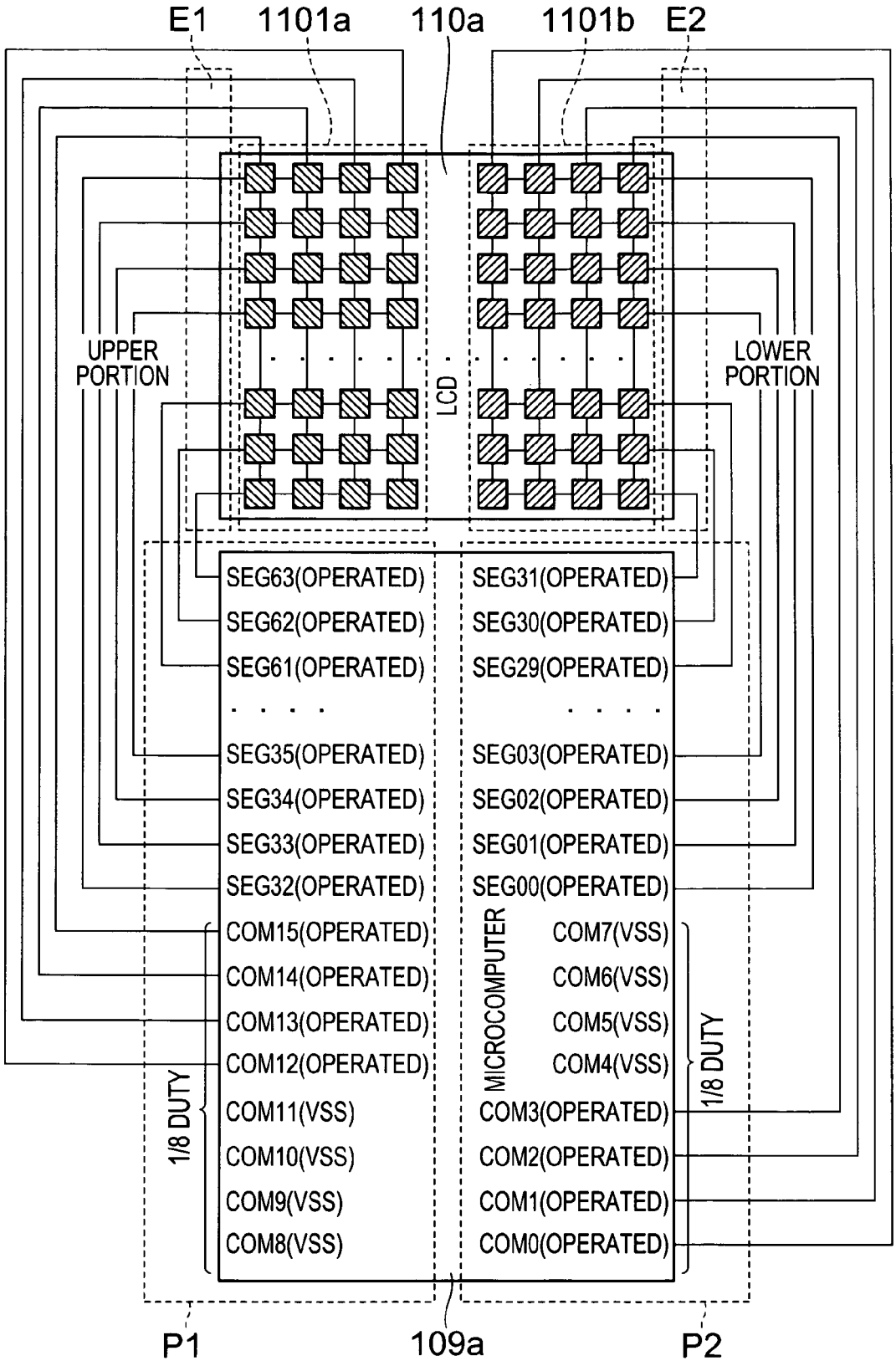
FIG. 11 is a diagram illustrating a configuration according to a second embodiment of the invention.

Hereinafter, a display device and an electronic apparatus using the display device will be described with reference to the drawings according to a second embodiment of the invention. FIG. 11 is a diagram illustrating a relationship between the LCD 110 and a display driving circuit 109*a* (circuit board) of a microcomputer. In this example, an LCD is connected to the display driving circuit 109*a* including eight common terminals COM and sixty four segments SEG.

The common terminals COM8 to COM15 and the segment terminals SEG32 to SEG63 are disposed on one side (P1) of the display driving circuit 109*a*. The common terminals COM0 to COM7 and the segment terminals SEG0 to SEG31 are disposed on the other side (P2) opposing the one side (P1) of the display driving circuit 109*a*.

Reference Numeral 1101*a* denotes a display block that is disposed in the upper portion of a display section 110*a* and an upper end portion E1 of the display block is wired. Reference Numeral 1101*b* denotes a display block that is disposed in the lower portion of the display section 110*a* and a lower end portion E2 of the display block is wired.

In FIG. 11, the common terminals COM12 to COM15 and the segment terminals SEG32 to SEG63 disposed on the one side P1 are connected to the display block 1101*a* present in the upper portion of the display section 110*a* via the upper end portion E1 of the display section 110*a*. The common terminals COM0 to COM3 and the segment terminals SEG0 to SEG31 disposed on the other side P2 are connected to the display block 1101*a* present in the lower portion of the display section 110*a* via the lower end portion E2 of the display section 110*a*.

Wirings connected to the segment terminals SEG0 to SEG31 and wirings connected to the segment terminals SEG32 to SEG63 are not connected to each other on the display section 110*a*.

Figure 12:
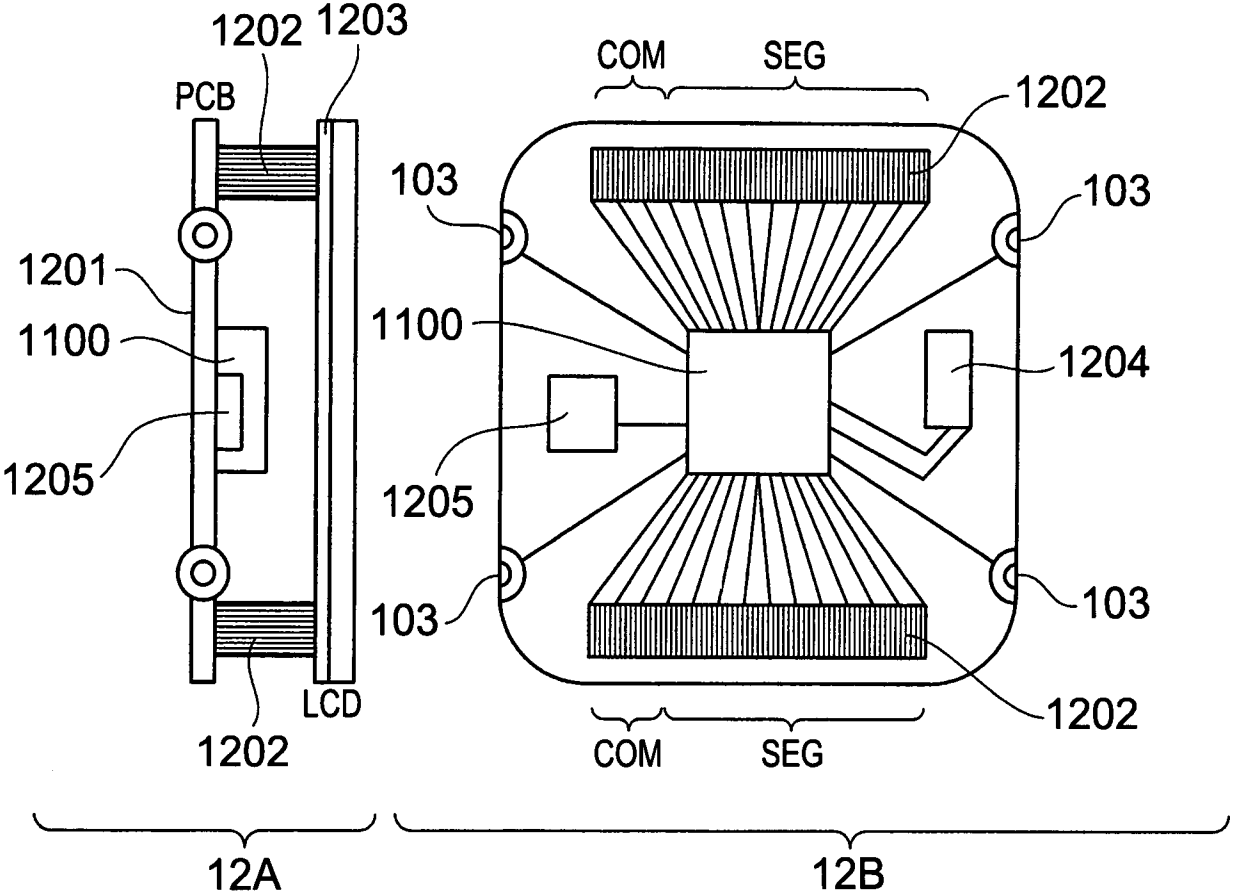
FIGS. 12A and 12B are diagrams illustrating a configuration according to the second embodiment of the invention.

FIGS. 12A and 12B are diagrams illustrating wirings of an electronic timepiece according to this embodiment. FIG. 12A is a left side view illustrating a board 1201 and an LCD and FIG. 12B is a front view illustrating the board 1201 when the LCD is detached. Switches 103 are disposed in the four corners of the board 1201.

A microcomputer 1100 having a display driving circuit 109*a*, an oscillation circuit 101, a frequency divider circuit 102, a ROM 104, and a RAM 105 therein is disposed on the board 1201. On the board 1201, there are provided wirings connecting the LCD 110 to the display driving circuit 109*a* disposed inside the microcomputer 1100, wirings connecting the input means 103 to the control circuit 108 disposed inside the microcomputer 1100, wirings connecting a crystal oscillator 1204 to the oscillation circuit 101 disposed inside the microcomputer 1100 on the board 1201, and wirings connecting the microcomputer 1100 to an EL driver (backlight driver) 1205. On the board 1201, the input means 103 is formed as a side through-hole.

The common terminals COM12 to COM15 and the segment terminals SEG32 to SEG63 disposed on the upper side P1 of the display driving circuit 109*a* are connected to terminals disposed in the upper end portion E1 of the LCD via a zebra connector 1202 and an ITO (transparent electrode) 1203. The common terminals COM0 to COM7 and the segment terminals SEG0 to SEG31 disposed on the lower side P2 of the display driving circuit 109*a* are connected to terminals disposed in the lower end portion E2 of the LCD via the zebra connector 1202 and the ITO 1203. Moreover, the common terminals COM (i) and COM (i+8) (where i=0 to 7) can output the same signal and the common terminals COM0 to COM7 and the common terminals COM8 to COM15 can independently be driven in the operations or at the ground potential Vss (OFF state).

As shown in FIG. 11, the wirings connected from the display driving circuit 109*a* to the LCD via the zebra connector 1202 and the ITO 1203 do not intersect the wirings connecting the display driving circuit 109*a* to the input means 103 on the board. The wirings connected from the display driving circuit 109*a* to the LCD via the zebra connector 1202 and the ITO 1203 do not intersect the wirings connecting the ROM 104, the RAM 105, and the voltage detection circuit 107 to each other.

Figure 13:
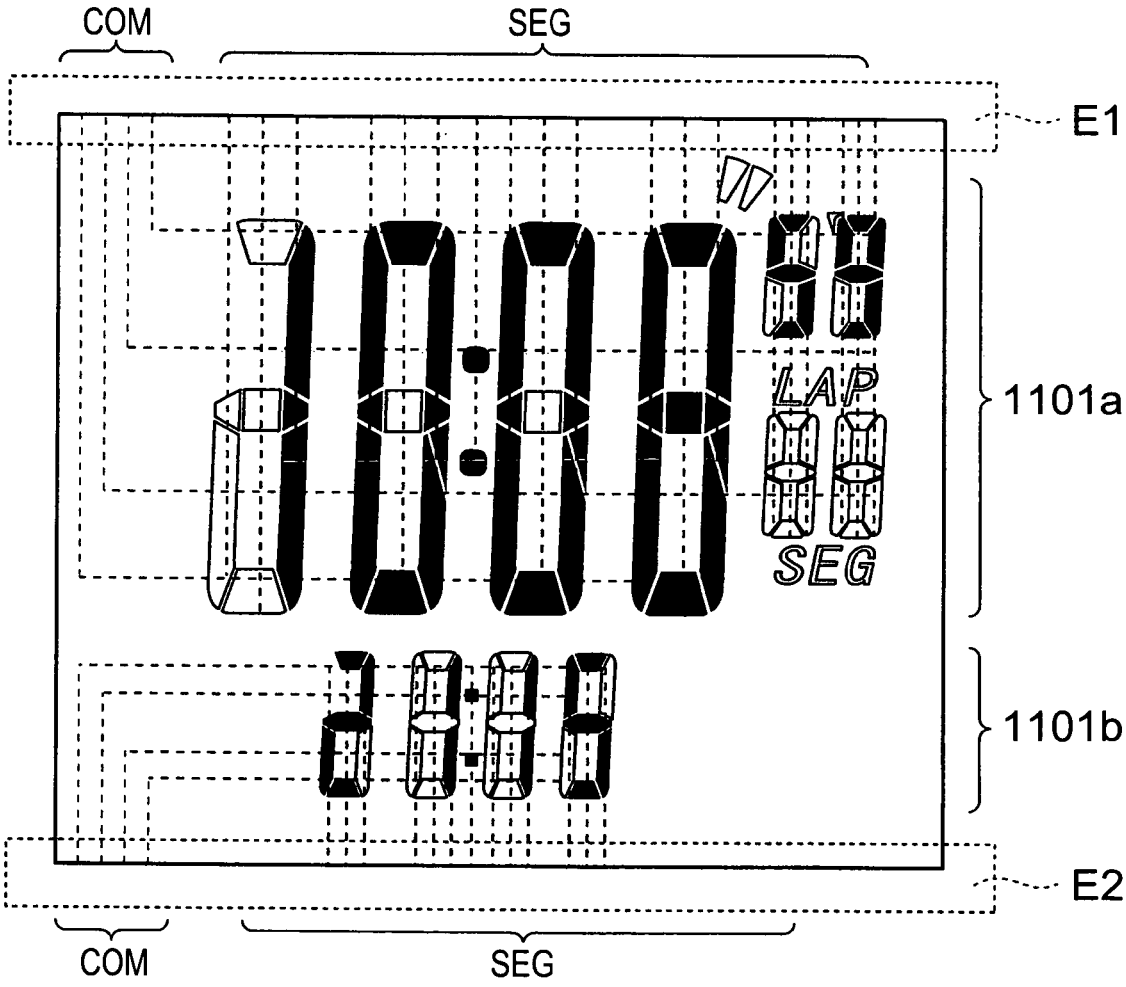
FIG. 13 is a diagram illustrating a display form according to the second embodiment of the invention.

FIG. 13 is a diagram illustrating an example of the LCD according to this embodiment. An upper display of the LCD is connected from the terminals disposed in the upper end portion E1 of the LCD to the terminals disposed in the upper portion P1 of the display driving circuit 109*a* via the zebra connector 1202, as shown in FIG. 12B. On the other hand, the lower display of the LCD is connected from the electrodes disposed in the lower end portion E2 of the LCD to the lower portion P2 of the display driving circuit 109*a* via the zebra connector 1202.

In the display section 110*a*, as described above, the two display blocks 1101*a* and 1101*b* respectively disposed in the upper portion and the lower portion are connected to the common terminals COM0 to COM7 and the common terminals COM8 to COM15, respectively. Therefore, the common terminals COM0 to COM7 and the common terminals COM8 to COM15 can be independently driven in the operation states or at the ground potential Vss (OFF state). That is, the display blocks 1101*a* and 1101*b* can be independently driven or not driven.

As described above, the display device according to this embodiment includes the display driving circuit 109*a* that includes the first driving means for driving the common terminals COM and the second driving means for driving the segment terminals SEG. The common terminals COM0 to COM7 and the segment terminals SEG0 to SEG31 are disposed on one side of the display driving circuit 109*a* and the common terminals COM8 to COM15 and the segment terminals SEG32 to SEG63 are disposed on the other side opposing the one side of the display driving circuit 109*a*. Moreover, the wirings connecting the one side of the display driving circuit 109*a* to the LCD do not intersect the wirings connecting the input means 103 to the display driving circuit 109*a*.

Accordingly, in the display device according to this embodiment, it is possible to reduce the number of lamination surfaces of the board 1201. Moreover, the display blocks 1101*a* and 1101*b* of the LCD may not be displayed (OFF state), as necessary. Since the common terminals COM can be in the ground potential (Vss) (OFF state) in the portion not being displayed, it is not necessary to supply the turn-off signal. Accordingly, it is possible to reduce the power consumption.

In this embodiment, the common terminals COM are disposed on two sides of the display driving circuit 109*a*. However, the common terminals COM may be disposed on three or more sides. Moreover, the number of common terminals COM may not be equal in the two sides. Instead, one common terminal COM may be disposed on one side and seven common terminals COM may be disposed on the other side.

Third Embodiment

Hereinafter, a display device and an electronic apparatus using the display device will be described with reference to the drawings according to a third embodiment.

Figure 14:
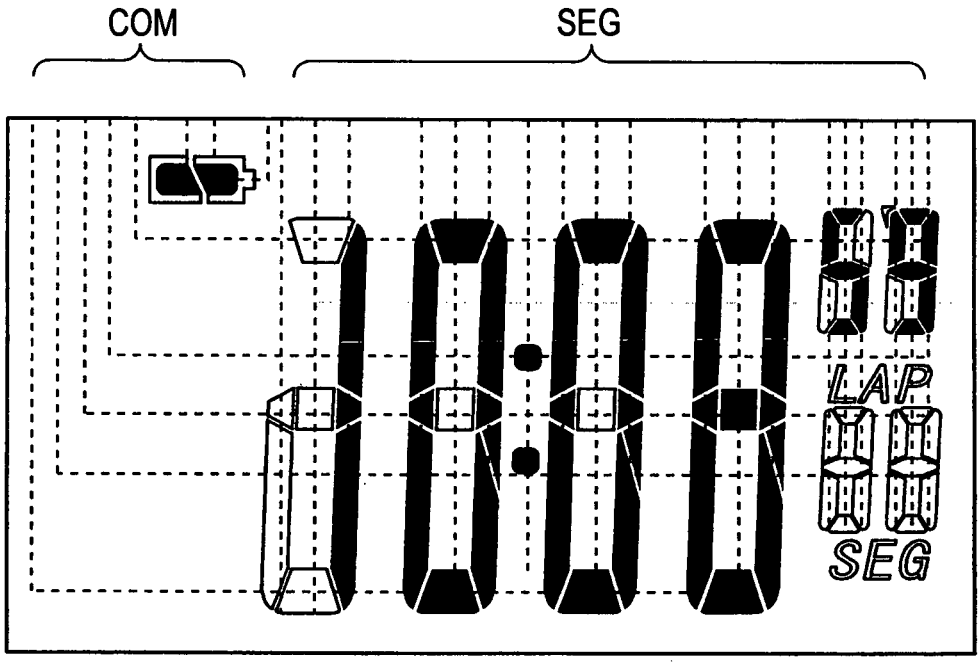
FIG. 14 is a diagram illustrating a display form according to a third embodiment of the invention.

FIG. 14 is a diagram illustrating an example of a display of an electronic timepiece including the display device according to the third embodiment of the invention. When the voltage of the battery 106 detected by the voltage detection circuit 107 is equal to or more than a predetermined value, the control circuit 108 turns on the battery mark of the mark display block 111, which means a state where the battery 106 can supply a sufficient power. The control circuit 108 changes over the display to the power save display, when the voltage of the battery is lowered and thus the voltage of the battery 106 detected by the voltage detection circuit 107 is less than the predetermined value. In this state, the control circuit 108 displays only the battery mark of the mark display block 111 at a predetermined frequency (for example, 2 Hz) in a blinking manner and does not drive the display blocks 112 and 113.

Figure 15A:
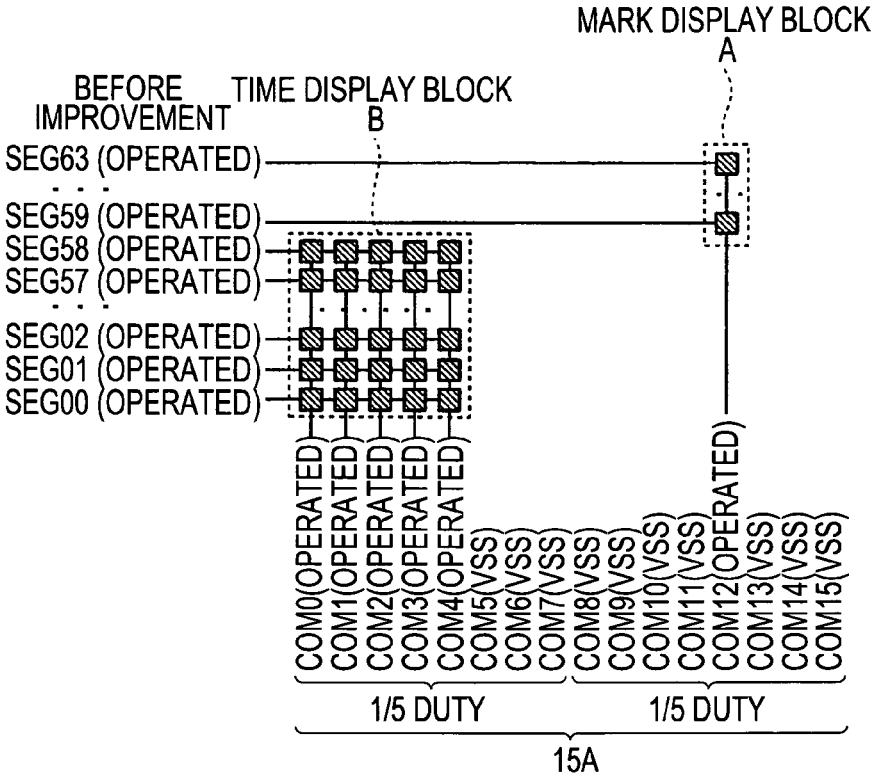
FIGS. 15A and 15B are diagrams illustrating operations according to the third embodiment of the invention.
Figure 15B:
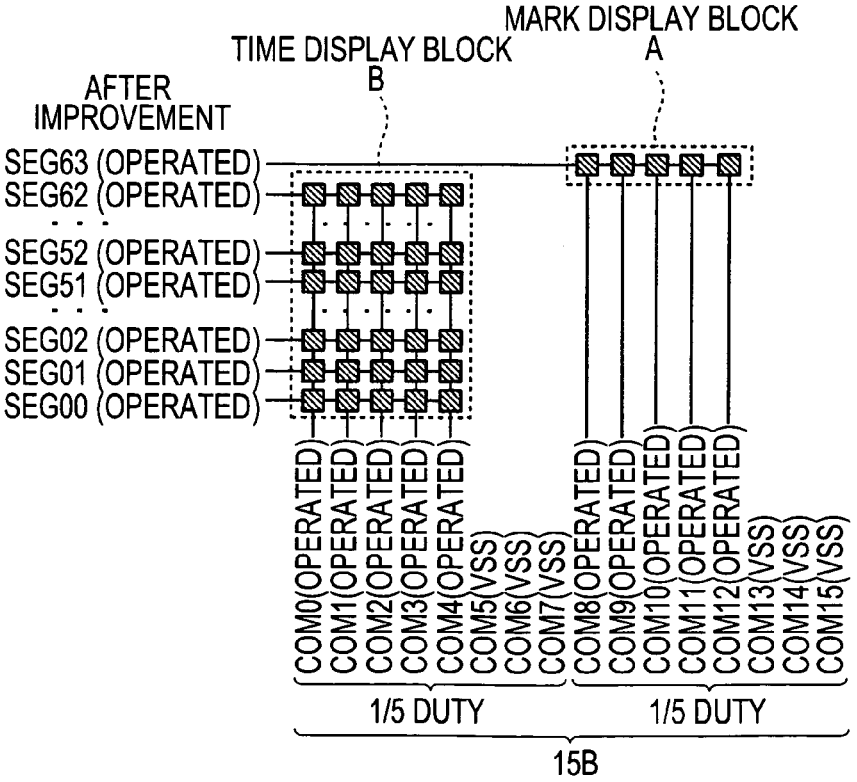

FIGS. 15A and 15B are diagrams illustrating examples of the wirings formed from the segment terminals SEG and the common terminals COM to the mark display block 111. In the example shown in FIG. 15A, five display components 114 of the mark display block 111 are controlled by one common terminal COM12 and five segment terminals SEG59 to SEG63.

On the other hand, in the example shown in FIG. 15B, five display components 114 of the mark display block 111 are controlled by five common terminals COM8 to COM12 and one segment terminal SEG63.

Here, the number of display components in the time display block 112 and the mark display block 111 will be examined. In the example shown in FIG. 15A, fifty nine segment terminals SEG0 to SEG58 and five common terminals COM0 to COM4 can be used for the display of the time display block 112. Accordingly, the number of display components 114 is 59×5=295 for the (time) display block 112 and is five for the mark display block 111. Therefore, three hundred display components 114 are displayed in total.

On the other hand, in the example shown in FIG. 15B, sixty three segment terminals SEG0 to SEG62 and five common terminals COM0 to COM4 can be used for the display of the time display block 112. Accordingly, the number of display components 114 is 63×5=315 for the (time) display block 112 and is five for the mark display block 111. Therefore, three hundred and twenty display components 114 are displayed in total.

In the display device according to this embodiment, as described above, the mark display block is driven by one segment terminal SEG63.

In the display device according to this embodiment, the maximum number of display components 114 of the time display block 112 can be used, while the number of display components of the mark display block 111 is maintained.

In the mark display block 111, information regarding charging, information regarding the power save mode, or the like as well as the voltage of the battery may be displayed.

Fourth Embodiment

Hereinafter, a display device and an electronic apparatus using the display device will be described with reference to the drawings according to a fourth embodiment of the invention.

Figure 16:
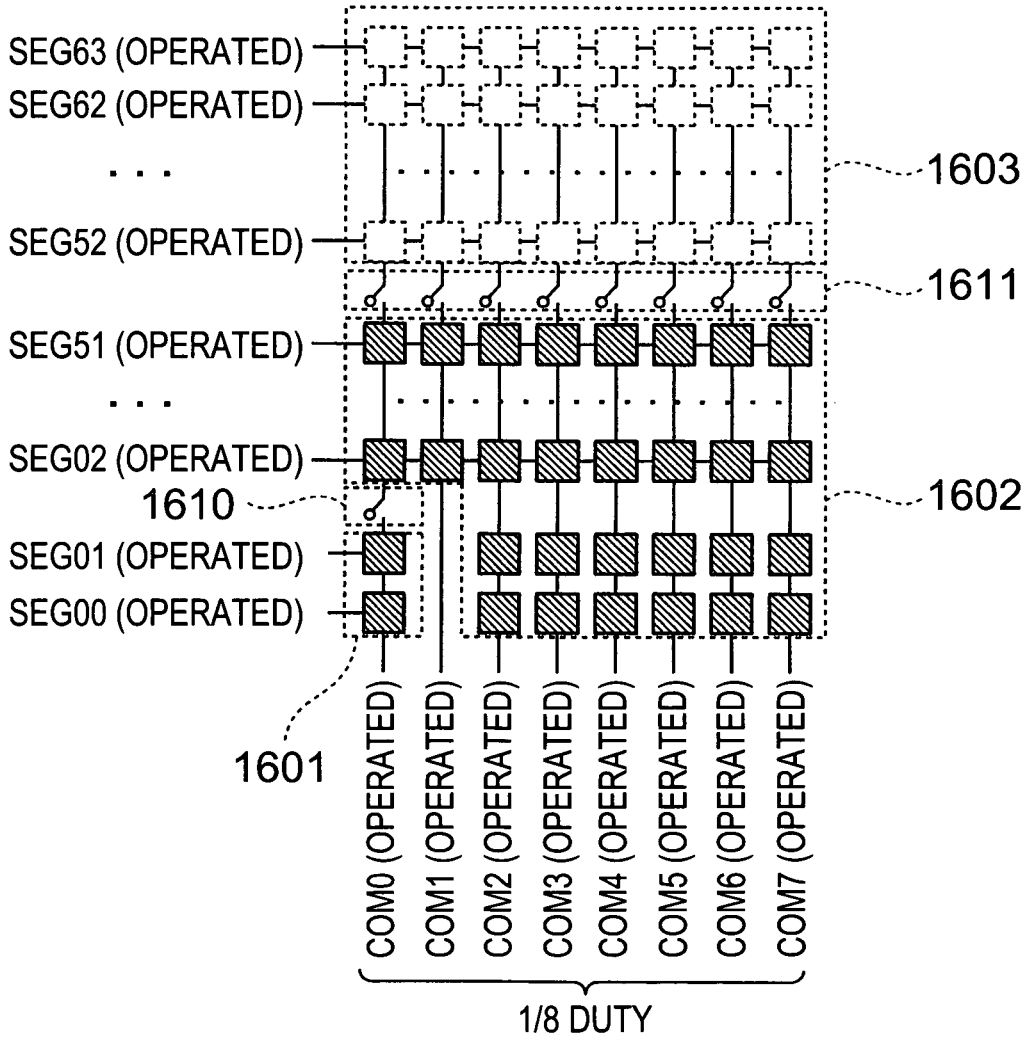
FIG. 16 is a diagram illustrating a configuration according to a fourth embodiment of the invention.
Figure 18:
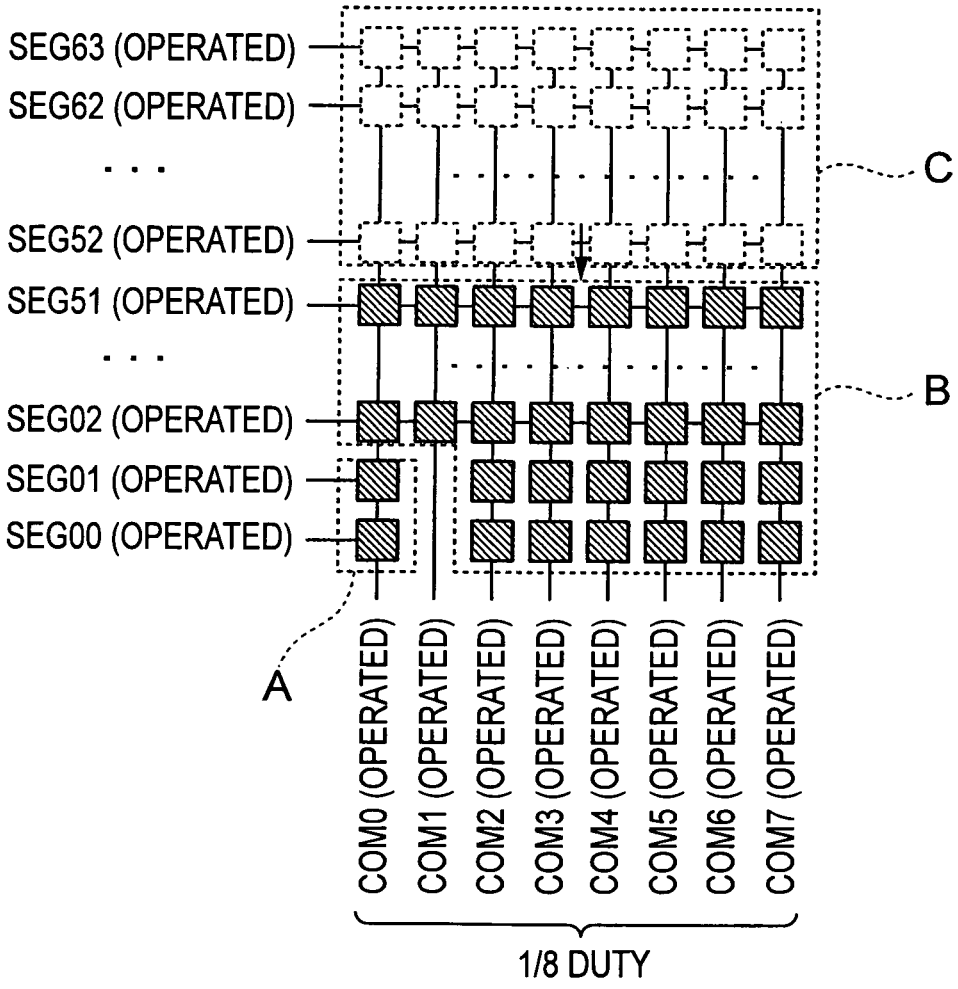
FIG. 18 PRIOR ART
FIG. 18 is a diagram illustrating an operation of a display device according to the related art.

FIG. 16 is a diagram illustrating an example of the LCD according to this embodiment. In this embodiment, the common terminals COM grouped for display blocks 1601, 1602, and 1603 are not used, but the common terminals COM0 to COM7 are commonly used for the respective blocks. A common disconnection switch 1610 is newly provided between the display blocks 1601 and 1602 of the common terminals COM0 and a common disconnection switch 1611 of an 8-circuit is newly provided between the display blocks 1602 and 1603 of the common terminals COM0 to COM7.

FIG. 17 is a diagram illustrating state combinations of the common disconnection switches 1610 and 1611 and the common terminals COM0 to COM7 and the driving states of the display blocks. When the common disconnection switch 1610 is disconnected, the common terminal COM0 is operated, and the common terminals COM1 to COM7 are driven at VSS, only the display block 1601 is driven. When the common disconnection switch 1610 is connected, the common disconnection switch 1611 is disconnected, and the common terminals COM0 to COM7 are operated, the display blocks 1601 and 1602 are driven. When the common disconnection switch 1610 is connected, the common disconnection switch 1611 is connected, and the common terminals COM0 to COM7 are operated, the display blocks 1601, 1602, and 1603 are driven.

As described above, the display device according to this embodiment includes the common disconnection switches 1610 and 1611 disconnecting the connection between the common terminal blocks.

In the display device according to this embodiment, the driving or non-driving of each display block may be selected by controlling the common disconnection switches 1610 and 1611 and the common terminals COM0 to COM7, although the common signals are not grouped. Accordingly, it is not necessary to output the turn-off signal to the block not being displayed, thereby achieving the power consumption.

The common disconnection switches 1610 and 1611 are operated by the control signal output and controlled from the control circuit 108. As the common disconnection switches

1610 and 1611, specifically, a transistor switch, an FET switch, a relay, or the like may be used. Moreover, a display device for various kinds of electronic apparatuses may be used.

In the above-described embodiments, the electronic timepiece has been used as an example. However, various kinds of electronic apparatuses such as a pedometer or a cellular phone including a display device may be used.

In the above-described embodiments, the rectangular display components 114 have been used. However, the shape of the display components may not be rectangular, but any shape may be used.

The invention is applicable not only to a display device of various kinds of electronic apparatuses such as an electronic timepiece, a pedometer, and a cellular phone but also to various kinds of electronic apparatuses including a display device.

What is claimed is:

1. A display device comprising:

a plurality of common terminals and a plurality of segment terminals connected to a plurality of display components and configured to be independently driven, the display components being divided into a plurality of display blocks configured to be turned ON to perform a display function and to be turned OFF so that the display blocks do not perform the display function;

first driving means for driving the plurality of common terminals, the first driving means comprising:

a common signal generation circuit that generates a common signal for scanning and driving the plurality of common terminals at a predetermined period, the common signal generation circuit having a plurality of output terminals;

a common changeover circuit including a plurality of common changeover switches; and a common signal changeover control circuit that separates the plurality of common terminals into a plurality of common terminal blocks each capable of being maintained at ground potential, and that controls changeover of the respective common changeover switches of the common changeover circuit so that the plurality of output terminals of the common signal generation circuit are allocated to common terminals corresponding to the plurality of common terminal blocks; and second driving means for driving the plurality of segment terminals based on a display signal;

wherein the first driving means drives the plurality of common terminals using a scanning signal of a predetermined period and the second driving means drives the plurality of segment terminals using a segment signal synchronized with the scanning signal to correspond to the display signal, so that the display components perform a display corresponding to the display signal; and wherein the first and second driving means perform the driving so that the common terminals and the segment terminals which are connected to display blocks of the display components that are turned OFF are not supplied with a turn-off signal and are maintained at ground potential so that no power is consumed by the display blocks that are turned OFF.

2. The display device according to claim 1, wherein the first driving means and second driving means perform the driving so that the display components are in a turn-on state or an OFF state.

3. The display device according to claim 2, further comprising:

a circuit board mounted with the first driving means and the second driving means, wherein the circuit board includes first segment terminals provided on one of both sides opposing each other and second segment terminals provided on the other of the both sides opposing each other, and wherein wirings connecting the first segment terminals to the display components and wirings connecting the second segment terminals to the display components do not intersect a wiring connecting an input means to the circuit board.

4. The display device according to claim 3, wherein the display components are driven by one segment terminal and the plurality of common terminals.

5. The display device according to claim 2, wherein the display components are driven by one segment terminal and the plurality of common terminals.

6. The display device according to claim 1, further comprising:

a circuit board mounted with the first driving means and the second driving means, wherein the circuit board includes first segment terminals provided on one of both sides opposing each other and second segment terminals provided on the other of the both sides opposing each other, and wherein wirings connecting the first segment terminals to the display components and wirings connecting the second segment terminals to the display components do not intersect a wiring connecting an input means to the circuit board.

7. The display device according to claim 6, wherein the display components are driven by one segment terminal and the plurality of common terminals.

8. The display device according to claim 1, wherein the display components are driven by one segment terminal and the plurality of common terminals.

9. The display device according to claim 1, further comprising common disconnection switches disconnecting connection between the plurality of common terminal blocks.

10. An electronic apparatus having the display device according to claim 1.

11. The electronic apparatus according to claim 10, further comprising time measurement means for measuring a time; and wherein the display device displays the time when the time measurement means measures the time.

12. The display device according to claim 1, wherein each of the terminal blocks of the common terminals is driven with the same duty ratio.

* * * * *